US010903591B2

(12) United States Patent
Zhang

(10) Patent No.: US 10,903,591 B2
(45) Date of Patent: Jan. 26, 2021

(54) ELECTRICAL CONNECTOR

(71) Applicant: LOTES CO., LTD, Keelung (TW)

(72) Inventor: Jun Zhang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/683,461

(22) Filed: Nov. 14, 2019

(65) Prior Publication Data

US 2020/0169016 A1 May 28, 2020

(30) Foreign Application Priority Data

Nov. 28, 2018 (CN) ..... 2018 1 1433168

(51) Int. Cl.
*H01R 12/70* (2011.01)
*H01R 13/40* (2006.01)
*H01R 13/502* (2006.01)

(52) U.S. Cl.
CPC ..... *H01R 12/7076* (2013.01); *H01R 12/7005* (2013.01); *H01R 13/40* (2013.01); *H01R 13/502* (2013.01)

(58) Field of Classification Search
CPC ..... H01R 12/7076; H01R 12/7005; H01R 13/40; H01R 13/502; H01R 13/514; H01R 12/82; H01R 13/516
USPC ..... 439/68
See application file for complete search history.

(56) References Cited

U.S. PATENT DOCUMENTS 7,059,869 B2 * 6/2006 Wertz ..... H01R 13/24 439/66
7,384,273 B1 * 6/2008 Polnyi ..... H01R 12/7052 439/526
8,047,881 B2 * 11/2011 Wang ..... H01R 13/502 439/717
9,660,403 B2 * 5/2017 Hochman ..... H01R 13/2407
(Continued)

FOREIGN PATENT DOCUMENTS

CN 201112669 Y 9/2008
CN 202285286 U 6/2012
CN 103762470 A 4/2014
(Continued)

*Primary Examiner* — Edwin A. Leon
(74) *Attorney, Agent, or Firm* — Locke Lord LLP; Tim Tingkang Xia, Esq.

(57) ABSTRACT

An electrical connector includes: an insulating frame, having an accommodating space to accommodate a chip module; a metal sheet, fixed to the insulating frame and provided with multiple positioning slots; and multiple insulating blocks respectively positioned correspondingly in the positioning slots movably in a vertical direction. The metal sheet has a first stopping portion and a second stopping portion on a periphery of each positioning slot. Each insulating block is formed separately from the insulating frame and accommodates multiple conductive terminals, and has a first protruding portion located above the first stopping portion, and a second protruding portion located below the second stopping portion, such that the first and second stopping portions restrict the insulating blocks from moving vertically. In the vertical direction, a gap exists between the first protruding portion and the first stopping portion, and a gap exists between the second protruding portion and the second stopping portion.

10 Claims, 12 Drawing Sheets

(56) References Cited

U.S. PATENT DOCUMENTS

| | | | | |
|---|---|---|---|---|
| 9,799,972 | B2 * | 10/2017 | Su | H01R 12/716 |
| 2018/0145441 | A1 * | 5/2018 | Ju | H05K 7/1069 |

FOREIGN PATENT DOCUMENTS

| | | | |
|---|---|---|---|
| CN | 103647174 | B | 5/2016 |
| CN | 205303808 | U | 6/2016 |
| CN | 108258466 | A | 7/2018 |
| TW | M320242 | U | 10/2007 |

* cited by examiner

A-A

C–C

D–D

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201811433168.6 filed in China on Nov. 28, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector for electrically connecting a chip module and a circuit board.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector is used for electrically connecting a chip module to a circuit board. The electrical connector has an insulating body and a plurality of terminals accommodated in the insulating body, and the insulating body is integrally formed by injection molding. As the functions of the newly introduced chip modules are becoming more powerful, more transmission points are needed, such that the quantity of terminals of the electrical connector is also increasing. The increase in the quantity of the terminals causes an increase in the area of the insulating body, which increases the manufacturing difficulty of the integral insulating body, and may cause other problems, such as warping of the insulating body. If the warping is severe, the flatness of the terminal is deteriorated, causing missing solders and solder skips of the terminals, and the terminals cannot be electrically connected to the circuit board normally. Based on this, another existing electrical connector is provided, such as the one disclosed in the Chinese patent application No. 201120323356.0. The electrical connector includes a frame and an insulating body assembled on the frame. The insulating body includes two independent body units, and a plurality of conductive terminals are accommodated in each of the body units. The frame is provided with multiple protruding posts, and each of the body units is provided with multiple mounting holes correspondingly matched with the protruding posts. The two independent body units are stably fixed to the frame through the mounting holes, thus forming a whole structure. Since the insulating body of the electrical connector is divided into the two separate body units and then assembled to the frame, the problem that an integral insulating body has a large volume and manufacturing thereof is difficult is solved. However, the circuit board may be warped due to temperature or load, and the surface thereof may not be completely flat. Since the body units are stably fixed to the frame, the positions of the body units cannot be adjusted vertically, and the recess of the surface of the circuit board cannot be electrically connected to the corresponding conductive terminals, thereby affecting the normal use of the electrical connector.

Therefore, a heretofore unaddressed need to design a new electrical connector exists in the art to address the aforementioned deficiencies and inadequacies.

SUMMARY

The present invention is directed to provide an electrical connector in which a plurality of separate insulating blocks are assembled by a metal sheet to ensure a firm structure and a good electrical connection between the conductive terminals and the circuit board.

In order to achieve the foregoing objective, the present invention adopts the following technical solutions:

An electrical connector is configured to electrically connect a chip module to a circuit board. The electrical connector includes: an insulating frame, having an accommodating space configured to accommodate the chip module; a metal sheet, fixed to the insulating frame and provided with a plurality of positioning slots located in the accommodating space, wherein the metal sheet is provided with a first stopping portion and a second stopping portion on a periphery of each of the positioning slots; and a plurality of insulating blocks separate from each other, respectively positioned correspondingly in the positioning slots movably in a vertical direction, wherein each of the insulating blocks is formed separately from the insulating frame and accommodates a plurality of conductive terminals to be conductively connected to the chip module; wherein each of the insulating blocks is provided with a first protruding portion and a second protruding portion, the first protruding portion is located above the first stopping portion such that the first stopping portion restricts the insulating blocks from moving downward, the second protruding portion is located below the second stopping portion such that the second stopping portion restricts the insulating blocks from moving upward, and in the vertical direction, a first gap exists between the first protruding portion and the first stopping portion, and a second gap exists between the second protruding portion and the second stopping portion.

In certain embodiments, the positioning slots includes two first positioning slots and a plurality of second positioning slots located on a periphery of the two first positioning slots, and each of the first positioning slots is larger than each of the second positioning slots.

In certain embodiments, each of the first positioning slots is defined by two first edges opposite to each other and two second edges opposite to each other, and a length of each of the first edges is greater than a length of each of the second edges; each of the second positioning slots is defined by two third edges opposite to each other and two fourth edges opposite to each other, and a length of each of the third edges is greater than a length of each of the fourth edges; a distance between each of the first edges of each of the first positioning slots and a corresponding one of the second positioning slots is less than a distance between each of the second edges of each of the first positioning slots and the corresponding one of the second positioning slots; and the metal sheet is provided with a plurality of second stopping portions, and the second stopping portions are respectively located on the two second edges of each of the first positioning slot and the two third edges of each of the second positioning slots.

In certain embodiments, the metal sheet is provided with a groove at one side of a corresponding one of the positioning slots, the groove is in communication with the corresponding one of the positioning slots, and the second stopping portion is formed by extending from the groove to the corresponding one of the positioning slots.

In certain embodiments, the first stopping portion and the second stopping portion are both flat plate shaped and located on a same plane, and a distance between the first protruding portion and the second protruding portion along the vertical direction is greater than a thickness of the metal sheet.

In certain embodiments, the electrical connector further includes at least one positioning post, wherein the positioning post has: a head portion downward abuts a top surface of the metal sheet; a connecting portion formed by extending downward from the head portion and running through the metal sheet and the insulating frame, the connecting portion is fixed to the insulating frame; and a tail portion formed by extending downward from the connecting portion and inserted into the circuit board, wherein vertical center lines of the head portion, the connecting portion and the tail portion are aligned.

In certain embodiments, the electrical connector further includes at least one retaining post running through the metal sheet, the insulating frame and the circuit board, wherein the retaining post has a bottom portion fixed in the circuit board and a retaining portion retaining the insulating frame.

In certain embodiments, the retaining post has a positioning portion, the chip module is provided with a matching hole for the positioning portion to enter therein to position the chip module, and vertical center lines of the positioning portion, the retaining portion and the bottom portion are aligned.

In certain embodiments, the electrical connector includes two retaining posts, wherein the two retaining posts are located at two diagonal positions of the insulating frame, the positioning portion of one of the retaining posts has a circular cross-section, and the positioning portion of the other of the retaining posts has a rhombic cross-section to prevent the chip module from being inserted inversely.

In certain embodiments, the insulating frame has a bottom wall supporting the metal sheet and a plurality of side walls formed by extending upward from a periphery of the bottom wall, and the accommodating space is defined by the bottom wall and the side walls.

Compared with the related art, the electrical connector according to certain embodiments of the present invention have the following beneficial effects.

Since the insulating blocks are separately provided, such that the whole electrical connector is divided into multiple smaller insulating blocks, the volume of each of the insulating blocks is reduced, and warping deformation of the insulating blocks can be effectively reduced. The separate insulating blocks are respectively positioned in the positioning slots of the metal sheet, and the metal sheet is further fixed to the insulating frame, such that and the presence of the metal sheet ensures the strength of the electrical connector. Further, the first stopping portion of the metal sheet is located below the first protruding portion to restrict the insulating blocks from moving downward, and the second stopping portion is located above the second protruding portion to restrict the insulating block from moving upward. In the vertical direction, a first gap exists between the first protruding portion and the first stopping portion, and a second gap exists between the second protruding portion and the second stopping portion, such that the insulating blocks can float vertically in the corresponding positioning slots of the metal sheet. Therefore, when the circuit board is warped and the surface thereof is not flat, each of the insulating blocks can be adjusted vertically according to the height of the corresponding surfaces of the circuit board that it contacts, such that all the conductive terminals can be aligned with the surface of the circuit board, thereby achieving a good electrical connection effect between the conductive terminals and the circuit board.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
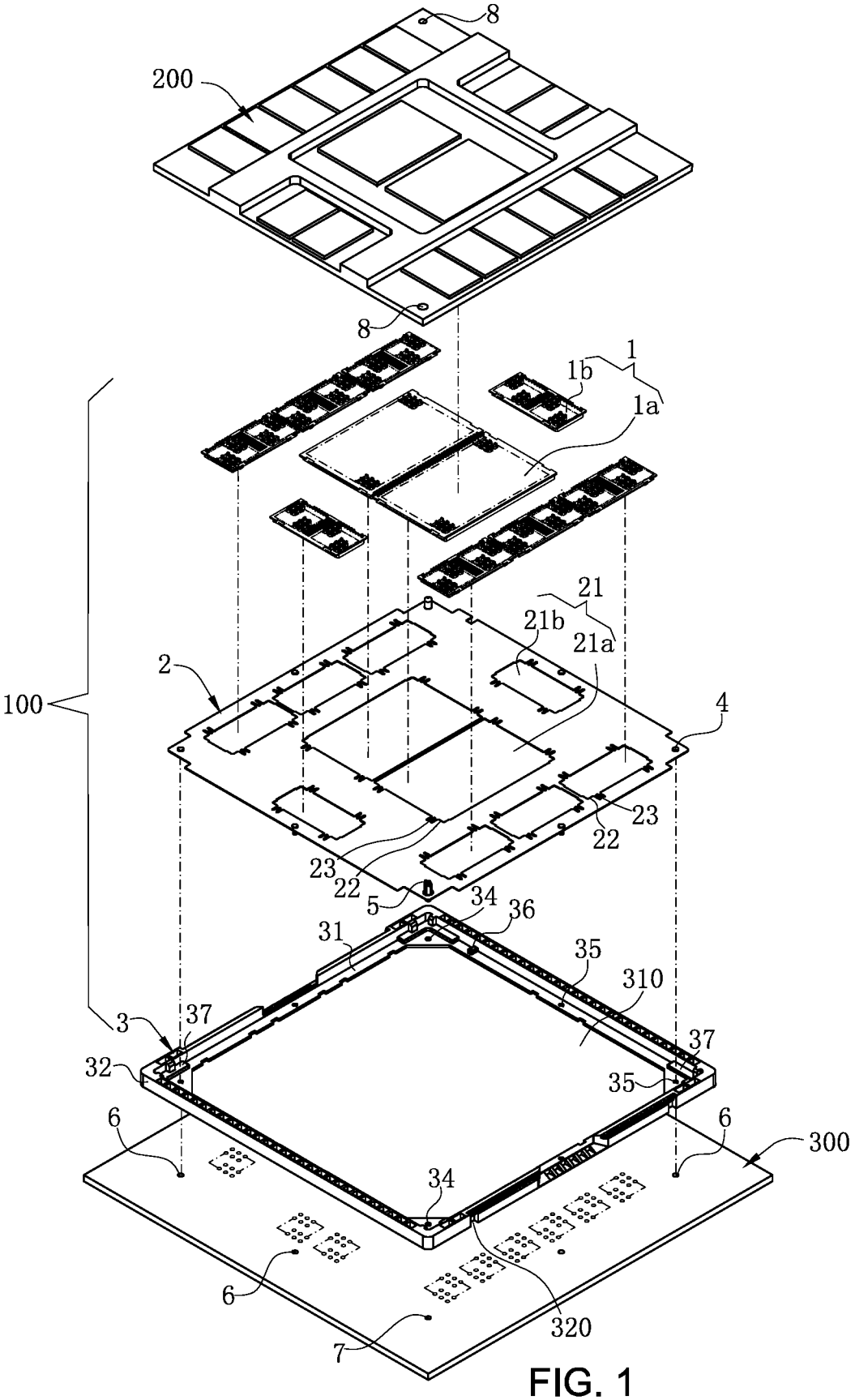
FIG. 1 is a perspective exploded view of an electrical connector according to certain embodiments of the present invention.
Figure 2:
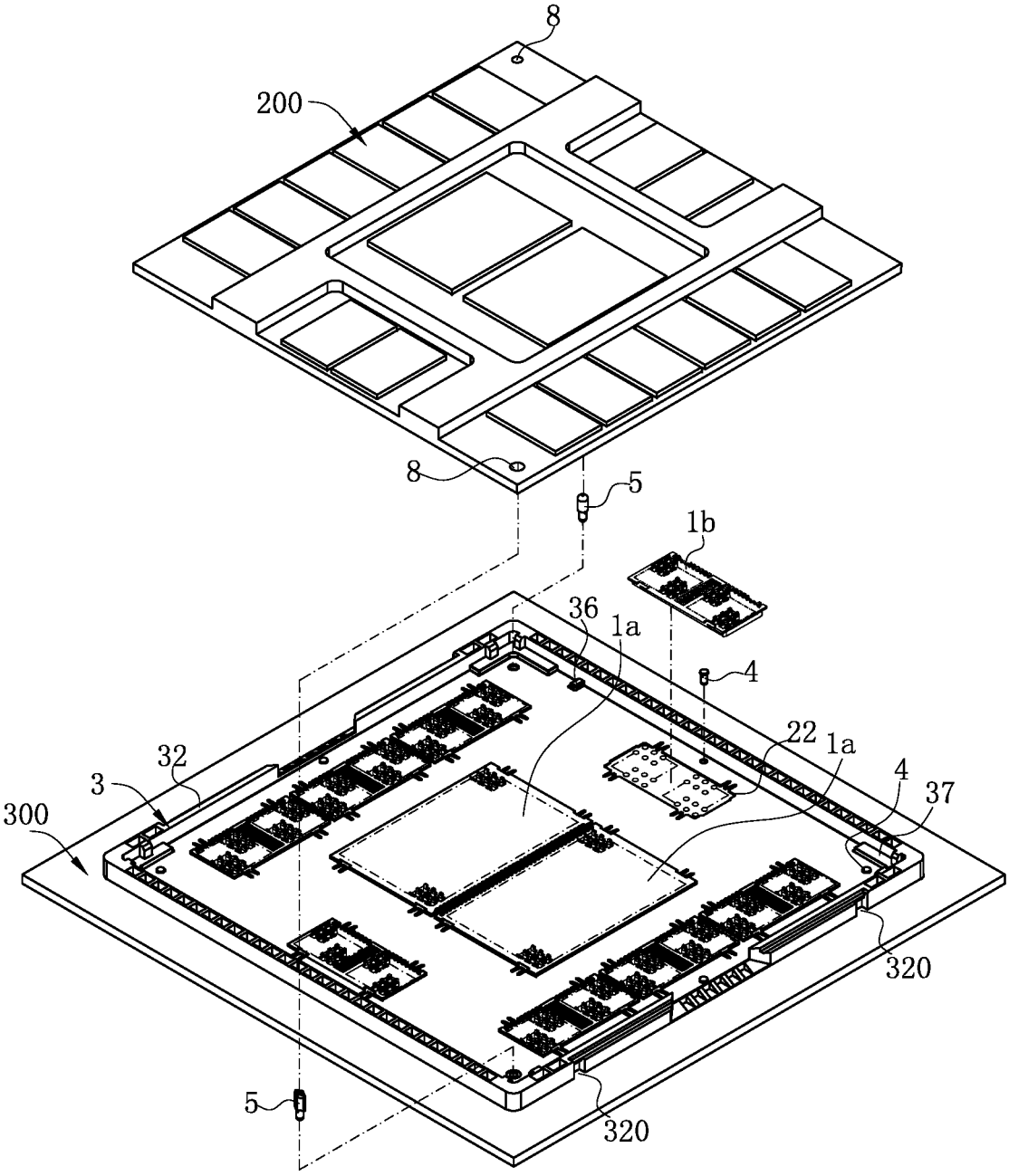
FIG. 2 is an assembled perspective view of the electrical connector according to certain embodiments of the present invention.
Figure 3:
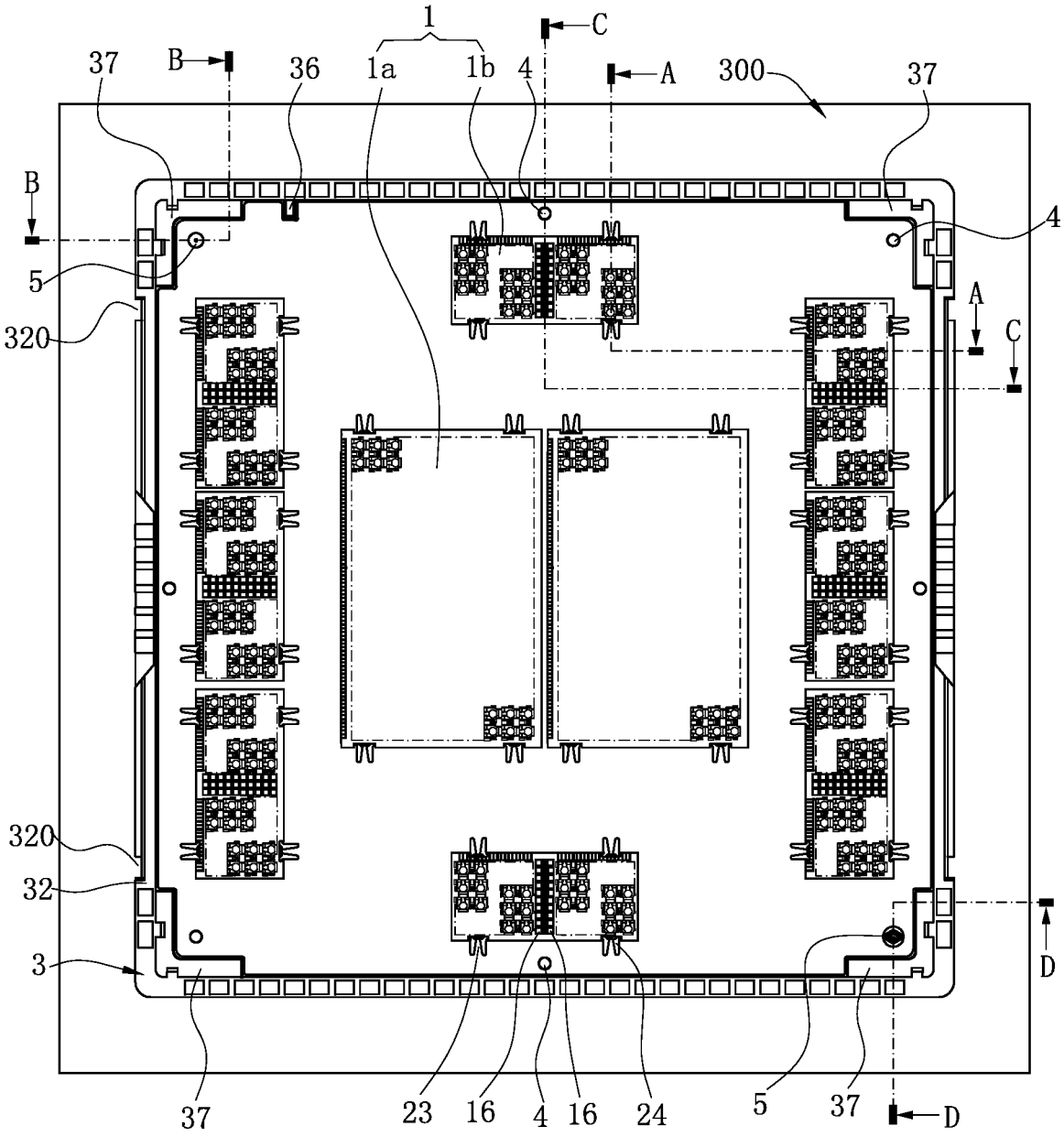
FIG. 3 is a top view of the electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the"

includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to an electrical connector.

As shown in FIGS. 1 to 4, an electrical connector 100 according to certain embodiments of the present invention is used to electrically connect a chip module 200 to a circuit board 300, and includes: an insulating frame 3, a metal sheet 2 fixed to the insulating frame 3, and a plurality of insulating blocks 1 separate to each other and movable vertically on the metal sheet 2. Each of the insulating blocks 1 is formed separately from the insulating frame 3 and accommodates a plurality of conductive terminals 9. An upper portion of each conductive terminal 9 is conductively connected to the chip module 200, and a lower portion thereof is soldered to the circuit board 300.

As shown in FIGS. 1 to 4, each of the insulating blocks 1 has an upper surface 11 and a lower surface 12, and a plurality of terminal accommodating slots 13 running vertically through the upper surface 11 and the lower surface 12 to accommodate a plurality of conductive terminals 9. Each insulating block 1 is provided with a plurality of first protruding portions 14 protruding horizontally outward from a periphery of the upper surface 11. Two opposite side surfaces of each insulating block 1 are respectively provided with two second protruding portions 15. Each second protruding portion 15 has a chamfer 151 connected to the lower surface 12. Each second protruding portion 15 is lower than each first protruding portion 14, and a gap exists between each first protruding portion 14 and a corresponding second protruding portion 15 in the vertical direction. The insulating blocks 1 include two identical first insulating blocks 1*a* and a plurality of second insulating blocks 1*b*. In this embodiment, a length of each second insulating block 1*b* provided along a length direction of the first insulating blocks 1*a* is slightly greater than a length of each second insulating block 1*b* provided along a width direction of the first insulating blocks 1*a*. The length of each first insulating block 1*a* is greater than the length of each second insulating block 1*b*, and the width of each first insulating block 1*a* is greater than the width of each second insulating block 1*b*. Each second insulating block 1*b* is provided with the terminal accommodating slots 13 in two regions, and a plurality of rows of slug slots 16 are provided between the two regions.

Figure 4:
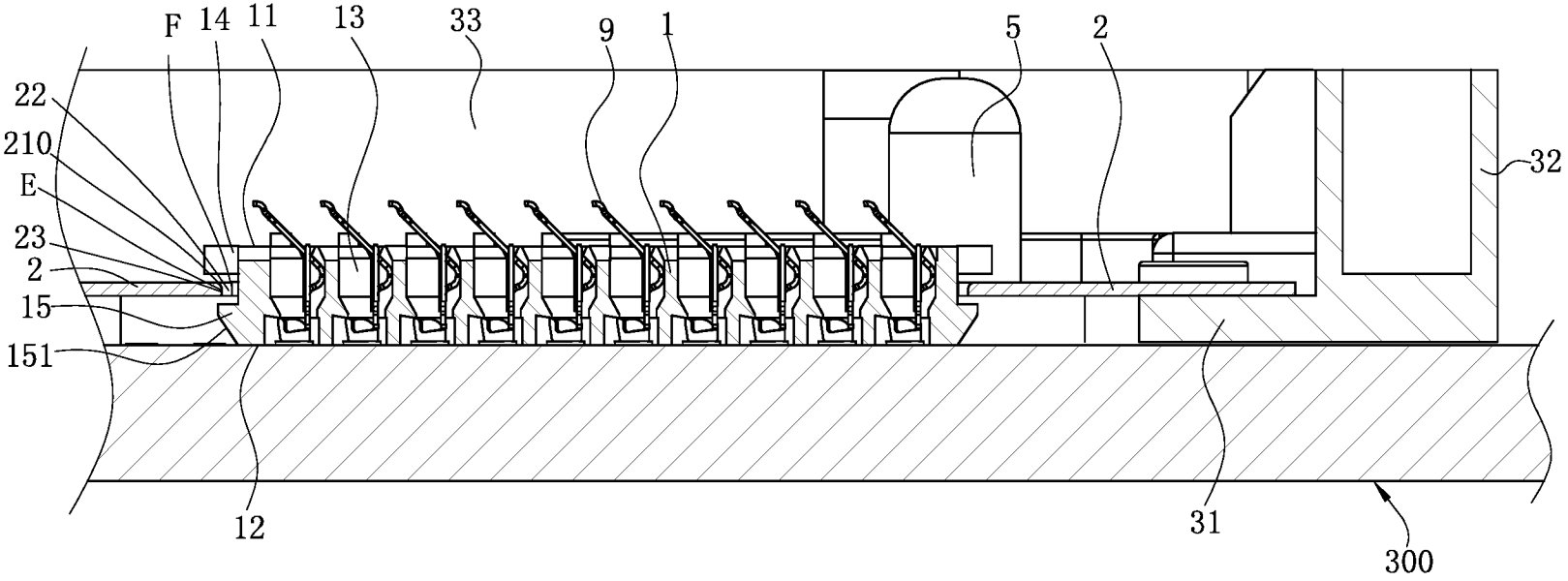
FIG. 4 is a sectional view of the electrical connector of FIG. 3 along line A-A.
Figure 5:
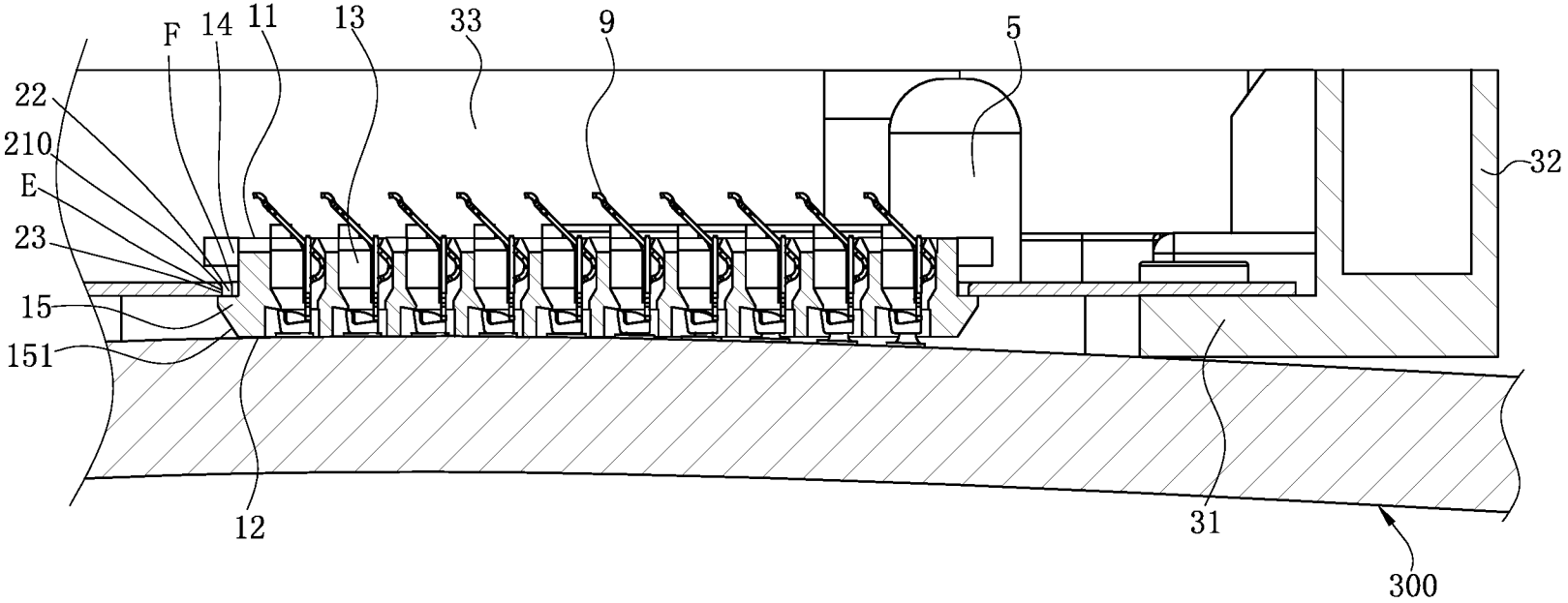
FIG. 5 is a schematic view of the circuit board of FIG. 4 being warped and deformed.

As shown in FIGS. 1 to 4 and FIG. 10, the metal sheet 2 is flat plate shaped, and a thickness of the metal sheet 2 in the vertical direction is less than the gap between each first protruding portion 14 and the corresponding second protruding portion 15. The metal sheet 2 is provided with a plurality of positioning slots 21, and any two of the positioning slots 21 are not in communication with each other. The insulating blocks 1 are positioned in the corresponding positioning slots 21. The metal sheet 2 is provided with a first stopping portion 22 on the periphery of the positioning slots 21, and a tail end F of the first stopping portion 22 horizontally protrudes from a corresponding side edge 210 of the corresponding positioning slot 21. The metal sheet 2 is respectively provided with two grooves 24 on two opposite side edges 210 of each positioning slot 21, and the grooves 24 are in communication with the positioning slot 21. A second stopping portion 23 is formed by extending from each groove 24 to the corresponding positioning slot 21, and a free end E of the second stopping portion 23 horizontally protrudes from a corresponding side edge 210 of the corresponding positioning slot 21. A length of the free end E of the second stopping portion 23 protruding from the corresponding side edge 210 is less than a length of the tail end F of the first stopping portion 22 protruding from the corresponding side edge 210 (as shown in FIG. 4). A width of the first stopping portion 22 is greater than a width of the second stopping portion 23, such that each insulating block 1 can be assembled downward in the corresponding positioning slot 21 conveniently. The first stopping portion 22 and the second stopping portion 23 are both flat plate shaped and located on the same plane. The positioning slots 21 include two identical first positioning slots 21*a* and a plurality of second positioning slots 21*b* located on the periphery of the two first positioning slots 21*a*. Each first insulating block 1*a* is correspondingly positioned in one of the first positioning slots 21*a*, and each second insulating block 1*b* is correspondingly positioned in one of the second positioning slots 21*b*. The first positioning slots 21*a* and the second positioning slots 21*b* are both substantially rectangular. Each first positioning slot 21*a* is defined by two first edges d1 opposite to each other and two second edges d2 opposite to each other, and a length of each first edge d1 is greater than a length of each second edge d2. Each second positioning slot 21*b* is defined by two third edges d3 opposite to each other and two fourth edges d4 opposite to each other, and a length of each third edge d3 is greater than a length of each fourth edge d4. The length L1 of each first edge d1 is greater than the length L2 of each third edge d3. The length W1 of each second edge d2 is greater than the length W2 of each fourth edge d4. A distance P1 between a first edge d1 and the corresponding second positioning slot 21*b* is less than a distance P2 between a second edge d2 and the corresponding second positioning slot 21*b*. The second stopping portions 23 are respectively located on the two second edges d2 of each first positioning slot 21*a* and the two third edges d3 of each second positioning slot 21*b*. Each of two diagonal positions of the metal sheet 2 is respectively provided with a first retaining holes 25, and each of the other two diagonal positions and the middle positions of the four edges is respectively provided with a first positioning hole 26. One side edge of the metal sheet 2 is further provided with a notch 27 adjacent to the first retaining hole 25.

As shown in FIGS. 1 to 5, during assembly, the chamfer 151 of each second protruding portion 15 can guide the corresponding insulating block 1 to be assembled downward into the corresponding positioning slot 21 of the metal sheet 2. In this process, the chamfer 151 abuts the corresponding second stopping portion 23 such that the second stopping portion 23 is elastically deformed downward until the second protruding portion 15 goes downward beyond the second stopping portion 23, and the second stopping portion 23 is restored to its original shape. When the insulating block 1 moves downward to a final position, each first protruding portion 14 is located above the corresponding first stopping portion 22 to restrict the insulating block 1 from moving downward, and each second protruding portion 15 is located below the corresponding second stopping portion 23 to restrict the insulating block 1 from moving upward. A first gap exists between the first stopping portion 22 and the first protruding portion 14 in the vertical direction, and a second gap exists between the second stopping portion 23 and the second protruding portion 15 in the vertical direction, such that the insulating body 1 can float vertically. Therefore, when the circuit board 300 is warped and the surface thereof is not flat, each of the insulating blocks 1 can be adjusted vertically according to the height of the corresponding surfaces of the circuit board 300 that it contacts, such that all the conductive terminals 9 can be aligned with the surface of the circuit board 300, thereby achieving a good soldering effect between the conductive terminals 9 and the circuit board 300.

As shown in FIGS. 1 to 4, FIGS. 6 and 7 and FIG. 9, the insulating frame 3 is provided with a bottom wall 31 and four side walls 32 formed by extending upward from the outer sides of the bottom wall 31, and an accommodating space 33 is jointly defined by the four side walls 32 and the bottom wall 31 (in other embodiments, the insulating frame 3 may not be provided with the bottom wall 31), in order to accommodate the chip module 200. The bottom wall 31 supports the metal sheet 2 upward to prevent from short-circuiting between the metal sheet 2 and the circuit board 300. The center of the bottom wall 31 is provided with a through hole 310 running through the bottom wall 31 vertically. Each of two diagonal positions of the bottom wall 31 is respectively provided with a second retaining hole 34 corresponding to one of the first retaining holes 25, and each of the other two diagonal positions and the middle positions of the four edges is respectively provided with a second positioning hole 35 corresponding to one of the first positioning holes 26. The bottom wall 31 is provided with a projecting portion 36 connected to the side wall 32 corresponding to the notch 27 of the metal sheet 2. The notch 27 fastens the projecting portion 36 to prevent the metal sheet 2 from being mounted inversely. A supporting portion 37 respectively protrudes upward from each of four corners of the bottom wall 31 to support the chip module 200. The height of each of the four side walls 32 is higher than the bottom surface of the chip module 200. Two of the side walls 32 opposite to each other are respectively provided with two buckling slots 320 to buckle a suction cover (not shown). The suction cover is sucked by a vacuum suction device, and is buckled to the insulating frame 3, thereby placing the electrical connector 100 on the circuit board 300.

Figure 7:
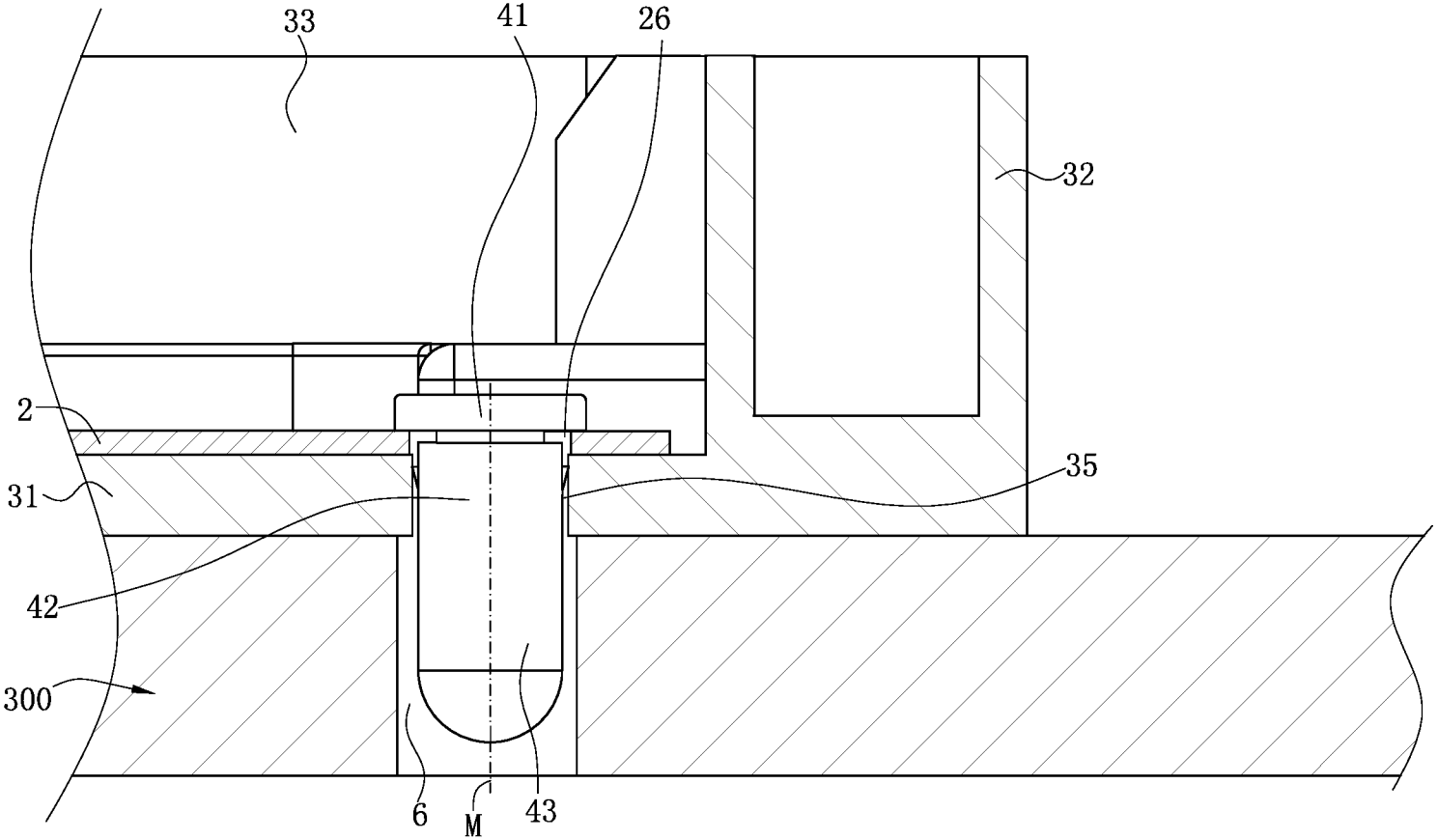
FIG. 7 is a sectional view of the electrical connector of FIG. 3 along line C-C.

As shown in FIGS. 1 to 3, FIG. 7 and FIG. 11, the electrical connector 100 further includes a plurality of positioning posts 4. Each positioning post 4 has a head portion 41, and a connecting portion 42 formed by extending downward from the head portion 41. A diameter of the connecting portion 42 is less than the diameter of the head portion 41, and the head portion 41 downward abuts the top surface of the metal sheet 2 to prevent the metal sheet 2 from moving upward. The connecting portion 42 runs downward through a corresponding first positioning hole 26 and a corresponding second positioning hole 35, and the connecting portion 42 is riveted to the corresponding second positioning hole 35 to fix the corresponding positioning post 4 to the insulating frame 3. A tail portion 43 is formed by extending downward from the connecting portion 42. The circuit board 300 is provided with a third positioning hole 6, and the tail portion 43 is inserted into the third positioning hole 6. The virtual center lines of the head portion 41, the connecting portion 42 and the tail portion 43 are respectively aligned in the vertical direction (as shown in FIG. 7, the virtual center lines of the three portions are all the center line M). The centers of the first positioning hole 26, the second positioning hole 35 and the third positioning hole 6 are aligned in the vertical direction, and the coaxial design is adopted, such that the assembly is simple and the assembly errors are reduced.

Figure 6:
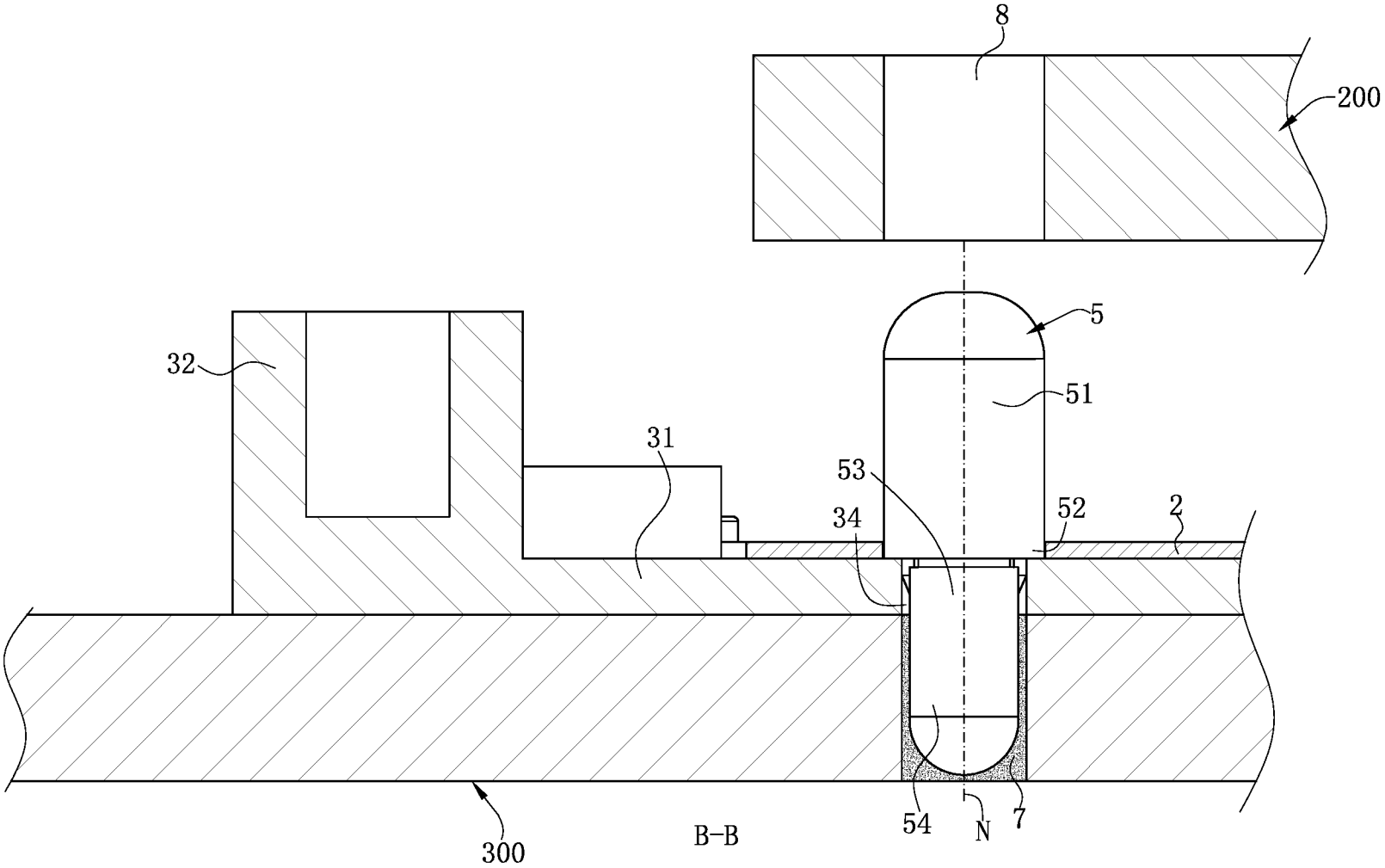
FIG. 6 is a sectional view of the electrical connector of FIG. 3 along line B-B.
Figure 8:
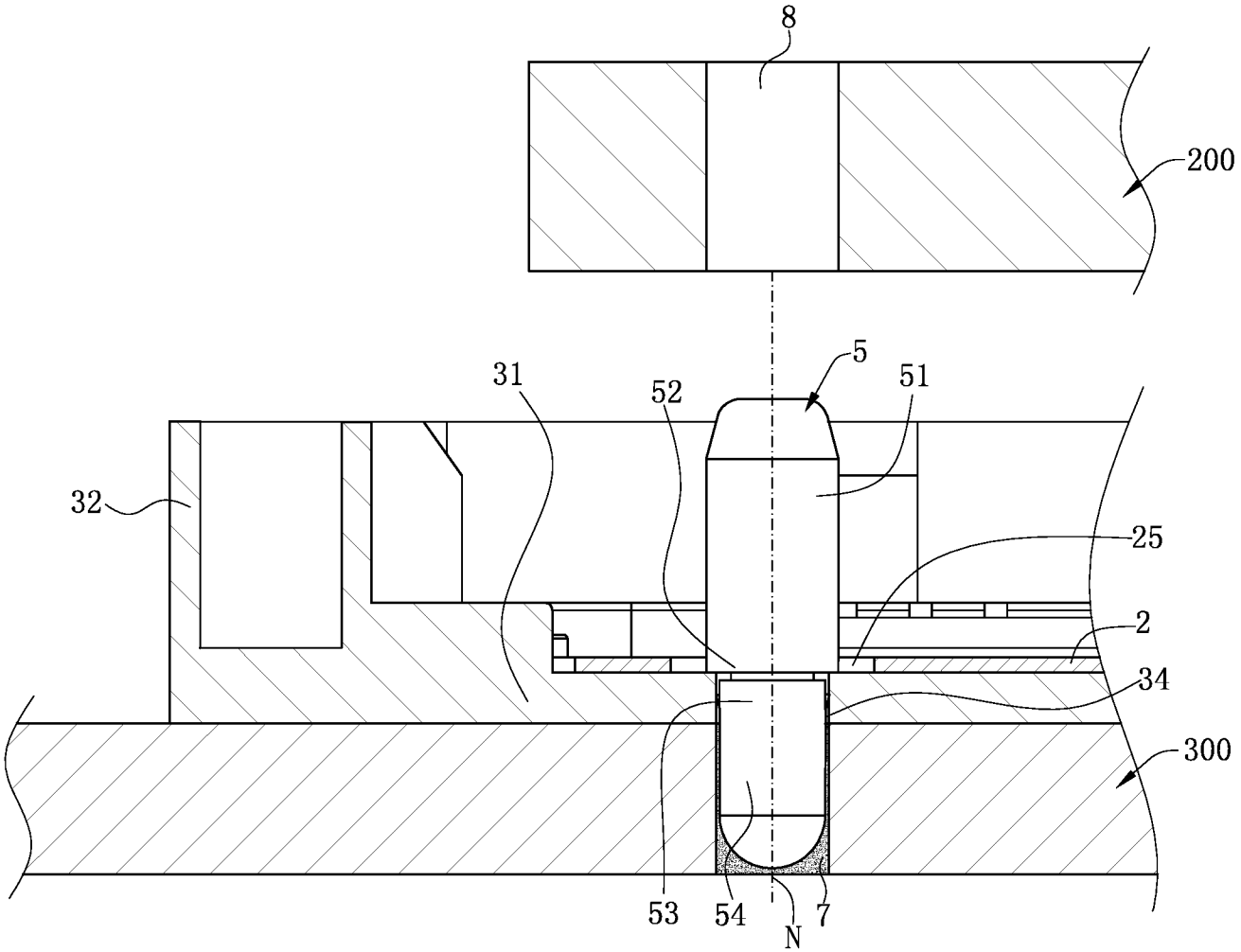
FIG. 8 is a sectional view of the electrical connector of FIG. 3 along line D-D.
Figure 9:
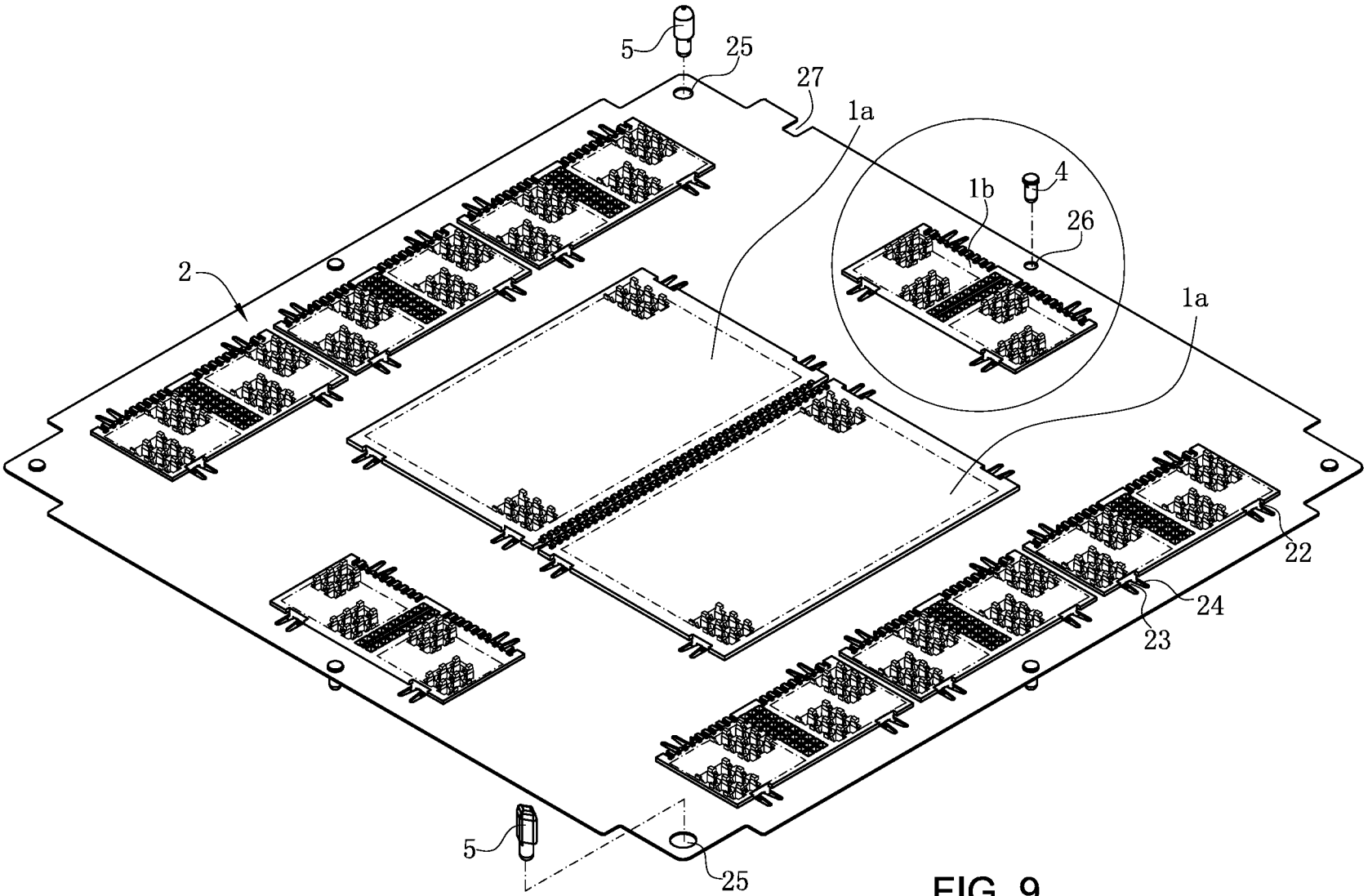
FIG. 9 is an assembled perspective view of the metal sheet and the insulating block of the electrical connector according to certain embodiments of the present invention.
Figure 10:
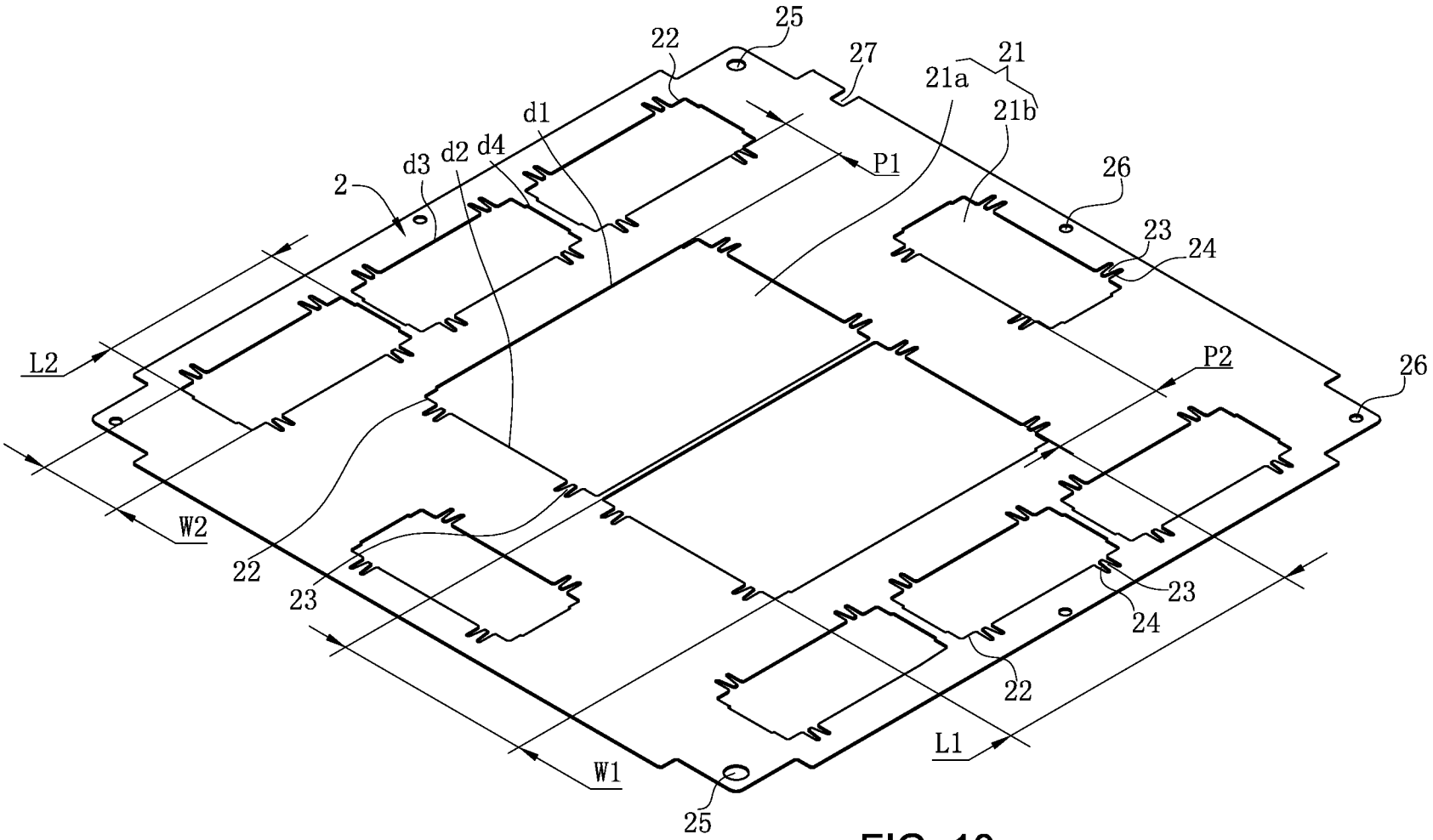
FIG. 10 is a perspective view of the metal sheet of the electrical connector according to certain embodiments of the present invention.
Figure 11:
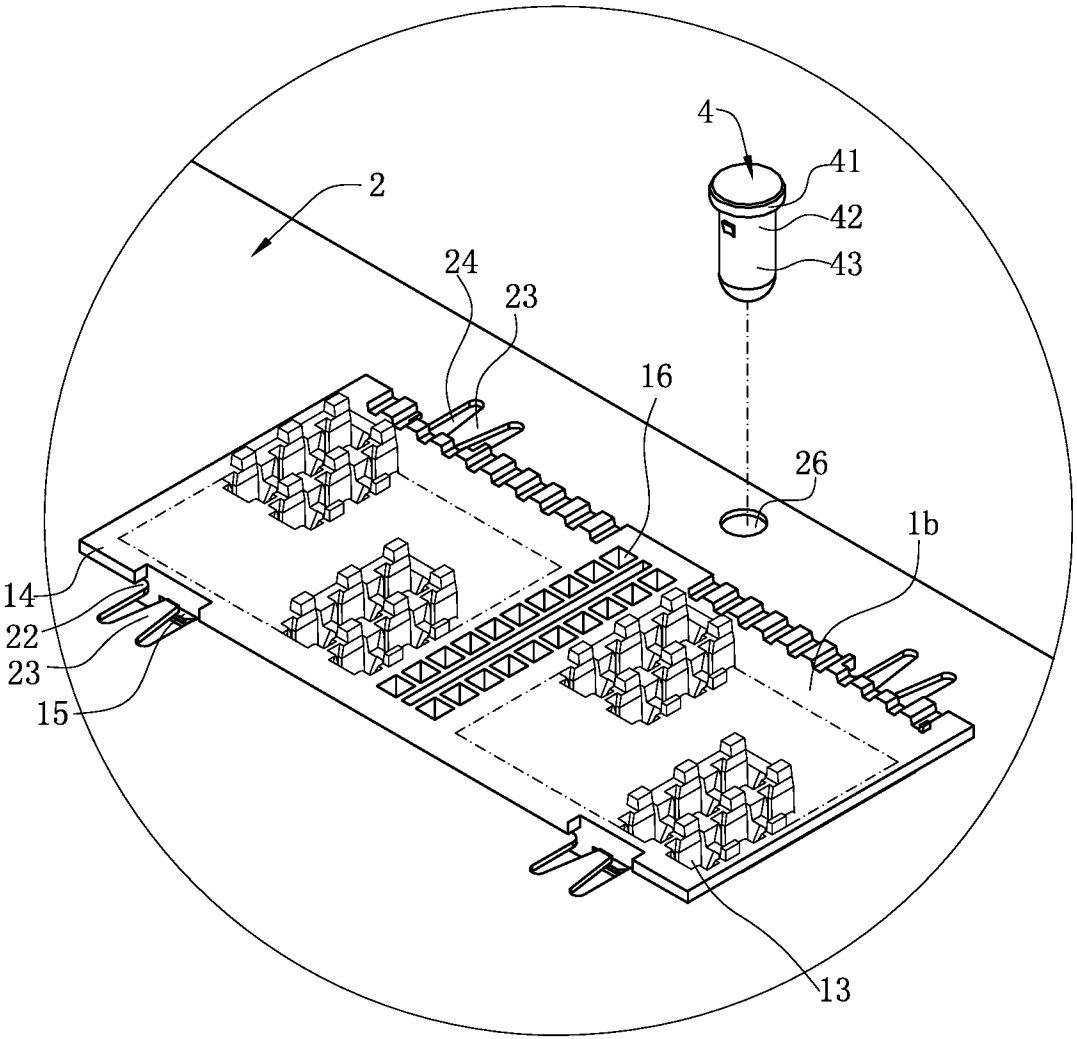
FIG. 11 is a partial enlarged view of FIG. 9.

As shown in FIGS. 1 to 3, FIG. 6, FIG. 8 and FIG. 12, the electrical connector 100 further includes two retaining posts 5. Each of the retaining posts 5 has a positioning portion 51, a first retaining portion 52 extending downward from the positioning portion 51, a second retaining portion 53 extending downward from the first retaining portion 52, and a bottom portion 54 formed by extending downward from the second retaining portion 53. The virtual center lines of the positioning portion 51, the first retaining portion 52, the second retaining portion 53 and the bottom portion 54 are respectively aligned in the vertical direction (as shown in FIG. 6 and FIG. 8, the virtual center lines of the four portions are all the center line N).

Figure 12:
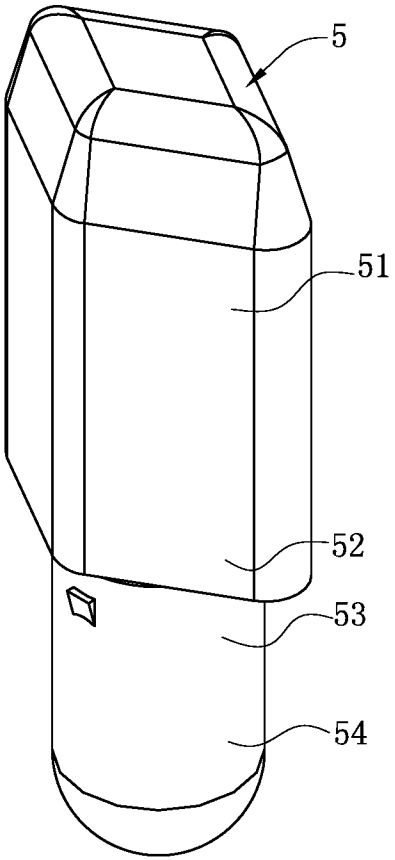
FIG. 12 is a perspective view of the two retaining posts of the electrical connector according to certain embodiments of the present invention.
Figure 12:
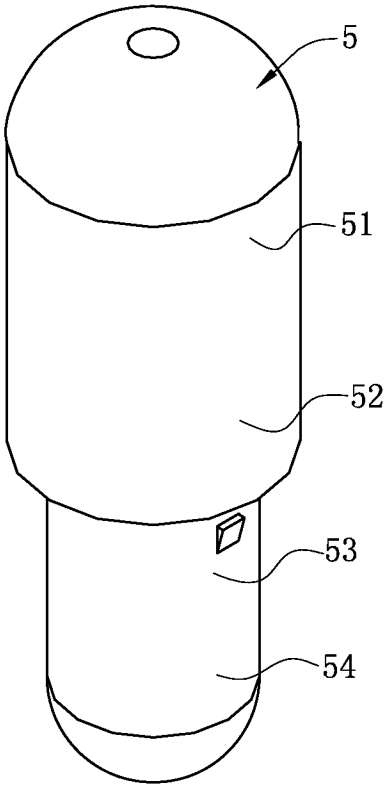

As shown in FIG. 6, FIG. 8 and FIG. 12, the first retaining portion 52 is closely matched with the corresponding first retaining hole 25 of the metal sheet 2 to prevent the metal sheet 2 from moving horizontally, and the second retaining portion 53 of the retaining post 5 is closely matched and fixed together with the corresponding second retaining hole 34 of the insulating frame 3. The circuit board 300 is provided with a third retaining hole 7 corresponding to each second retaining hole 34, and the bottom portion 54 is soldered into the third retaining hole 7. The chip module 200 is provided with a matching hole 8 corresponding to each first retaining hole 25, and the positioning portion 51 enters the matching hole 8 to position the chip module 200. In the two retaining posts 5, the positioning portion 51 of one of the retaining posts 5 has a circular cross-section, and the positioning portion 51 of the other of the retaining posts 5 has a rhombic cross-section, and a diameter of the circle is less than a length of the longer diagonal of the rhombus to prevent the chip module 200 from being inserted inversely. The centers of the first retaining hole 25, the second retaining hole 34, the third retaining hole 7 and the matching hole 8 are aligned in the vertical direction, and the coaxial design is adopted, such that the assembly is simple and the assembly errors are reduced.

During assembly, the conductive terminals 9 are firstly assembled to each insulating block 1. Then, each insulating block 1 is assembled downward to the corresponding positioning slot 21 of the metal sheet 2. Then, the metal sheet 2 with the insulating blocks 1 is further assembled downward to the insulating frame 3 through the retaining posts 5 and the positioning posts 4. Then, the retaining posts 5 are soldered to the circuit board 300, such that the insulating frame 3 is fixed to the circuit board 300 through the retaining posts 5, and the conductive terminals 9 are soldered to the circuit board 300. Finally, the chip module 200 is assembled onto the insulating blocks 1 through the matching of the positioning portions 51 and the matching holes 8.

To sum up, the electrical connector 100 according to certain embodiments of the present invention has the following beneficial effects:

(1) The insulating blocks 1 are respectively positioned in the positioning slots 21 of the metal sheet 2, and the metal sheet 2 is further fixed to the insulating frame 3. The presence of the metal sheet 2 ensures the strength of the electrical connector 100. The first stopping portion 22 of the metal sheet 2 is located below the first protruding portion 14 to restrict the insulating block 1 from moving downward, and the second stopping portion 23 is located above the second protruding portion 15 to restrict the insulating block 1 from moving upward. In the vertical direction, a first gap exists between the first protruding portion 14 and the first stopping portion 22 and a second gap exists between the second protruding portion 15 and the second stopping portion 23. By such design, the insulating blocks 1 can float vertically in the positioning slots 21 of the metal sheet 2. Therefore, when the circuit board 300 is warped and the surface is not flat, each of the insulating blocks 1 can be adjusted vertically according to the height of the corresponding surfaces of the circuit board 300 that it contacts, such that all the conductive terminals 9 can be aligned with the surface of the circuit board 300, thereby achieving a good electrical connection effect between the conductive terminals 9 and the circuit board 300.

(2) The vertical center lines of the head portion 41, the connecting portion 42 and the tail portion 43 of each positioning post 4 are aligned, and the vertical center lines of the bottom portion 54, the second retaining portion 53, the first retaining portion 52 and the positioning portion 51 of each retaining post 5 are aligned. Thus, the coaxial design is adopted, such that the assembly is simple and the assembly errors are reduced.

(3) The second stopping portion 23 is formed by extending from the groove 24 to enhance the elasticity of the second stopping portion 23. The first stopping portion 22 and the second stopping portion 23 are both flat plate shaped and located on the same plane, such that the metal sheet 2 is simple in structure and convenient to form. In addition, as long as the distance between the first protruding portion 14 and the second protruding portion 15 in the vertical direction is greater than the thickness of the metal sheet 2, it is possible that the first gap exists between the first protruding portion 14 and the first stopping portion 22 and the second gap exists between the second protruding portion 15 and the second stopping portion 23, such that the distance between the first protruding portion 14 and the second protruding portion 15 can be reduced, thereby reducing the thickness of the insulating block 1 and being in line with the trend of being ultrathin.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a chip module to a circuit board, the electrical connector comprising:

an insulating frame, having an accommodating space configured to accommodate the chip module;

a metal sheet, fixed to the insulating frame and provided with a plurality of positioning slots located in the accommodating space, wherein the metal sheet is provided with a first stopping portion and a second stopping portion on a periphery of each of the positioning slots; and a plurality of insulating blocks separate from each other, respectively positioned correspondingly in the positioning slots movably in a vertical direction, wherein each of the insulating blocks is formed separately from the insulating frame and accommodates a plurality of conductive terminals to be conductively connected to the chip module;

wherein each of the insulating blocks is provided with a first protruding portion and a second protruding portion, the first protruding portion is located above the first stopping portion such that the first stopping portion restricts the insulating blocks from moving downward, the second protruding portion is located below the second stopping portion such that the second stopping portion restricts the insulating blocks from moving upward, and in the vertical direction, a first gap exists between the first protruding portion and the first stopping portion, and a second gap exists between the second protruding portion and the second stopping portion.

2. The electrical connector according to claim 1, wherein the positioning slots comprise two first positioning slots and a plurality of second positioning slots located on a periphery of the two first positioning slots, and each of the first positioning slots is larger than each of the second positioning slots.

3. The electrical connector according to claim 2, wherein:

each of the first positioning slots is defined by two first edges opposite to each other and two second edges opposite to each other, and a length of each of the first edges is greater than a length of each of the second edges;

each of the second positioning slots is defined by two third edges opposite to each other and two fourth edges opposite to each other, and a length of each of the third edges is greater than a length of each of the fourth edges;

a distance between each of the first edges of each of the first positioning slots and a corresponding one of the second positioning slots is less than a distance between each of the second edges of each of the first positioning slots and the corresponding one of the second positioning slots; and the metal sheet is provided with a plurality of second stopping portions, and the second stopping portions are respectively located on the two second edges of each of the first positioning slot and the two third edges of each of the second positioning slots.

4. The electrical connector according to claim 1, wherein the metal sheet is provided with a groove at one side of a corresponding one of the positioning slots, the groove is in communication with the corresponding one of the positioning slots, and the second stopping portion is formed by extending from the groove to the corresponding one of the positioning slots.

5. The electrical connector according to claim 1, wherein the first stopping portion and the second stopping portion are both flat plate shaped and located on a same plane, and a distance between the first protruding portion and the second protruding portion along the vertical direction is greater than a thickness of the metal sheet.

6. The electrical connector according to claim 1, further comprising at least one positioning post, wherein the positioning post has:

a head portion downward abuts a top surface of the metal sheet;

a connecting portion formed by extending downward from the head portion and running through the metal sheet and the insulating frame, the connecting portion is fixed to the insulating frame; and a tail portion formed by extending downward from the connecting portion and inserted into the circuit board, wherein vertical center lines of the head portion, the connecting portion and the tail portion are aligned.

7. The electrical connector according to claim 1, further comprising at least one retaining post running through the metal sheet, the insulating frame and the circuit board, wherein the retaining post has a bottom portion fixed in the circuit board and a retaining portion retaining the insulating frame.

8. The electrical connector according to claim 7, wherein the retaining post has a positioning portion, the chip module is provided with a matching hole for the positioning portion to enter therein to position the chip module, and vertical center lines of the positioning portion, the retaining portion and the bottom portion are aligned.

9. The electrical connector according to claim 8, comprising two retaining posts, wherein the two retaining posts are located at two diagonal positions of the insulating frame, the positioning portion of one of the retaining posts has a circular cross-section, and the positioning portion of the other of the retaining posts has a rhombic cross-section to prevent the chip module from being inserted inversely.

10. The electrical connector according to claim 1, wherein the insulating frame has a bottom wall supporting the metal sheet and a plurality of side walls formed by extending upward from a periphery of the bottom wall, and the accommodating space is defined by the bottom wall and the side walls.

* * * * *